US005449040A

United States Patent [19]

Milner et al.

[11] Patent Number: 5,449,040

[45] Date of Patent: Sep. 12, 1995

[54] WIRELINE-SET TUBING-RELEASE PACKER APPARATUS

[76] Inventors: John E. Milner, 6313 Wilshire Dr., Tyler, Tex. 75703; David L. Farley, 415 Woodvale Ave., Lafayette, La. 70503

[21] Appl. No.: 317,753

[22] Filed: Oct. 4, 1994

[51] Int. Cl.[6] ..... E21B 33/129; E21B 33/13

[52] U.S. Cl. ..... 166/382; 166/123; 166/137; 166/385; 166/387

[58] Field of Search ..... 166/387, 123, 124, 181, 166/137, 134, 385, 382, 217

[56] References Cited

U.S. PATENT DOCUMENTS

| | | | |
|---|---|---|---|
| 3,572,442 | 3/1971 | Templeton | 166/217 |
| 4,648,446 | 3/1987 | Fore et al. | 166/123 |
| 4,693,309 | 9/1987 | Caskey et al. | 166/123 |
| 5,048,613 | 9/1991 | Shilling | 166/123 X |
| 5,197,547 | 3/1993 | Morgan | 166/387 |

*Primary Examiner*—Stephen J. Novosad
*Attorney, Agent, or Firm*—Pravel, Hewitt, Kimball & Krieger

[57] ABSTRACT

A tool, known as FM/WL Tool, utilized with a wireline adaptor kit would be secured to the lower end of a wireline setting tool. The adaptor kit would release from the tool when sufficient setting force is applied, and is retrieved with the wireline setting tool. The wireline setting tool provides for a telescoping action and sufficient force in order to push the outer parts down from the top as the inner mandrel of the tool and the stinger, top sub and bottom sub are pulled upward. The upward pull is transferred to a sleeve by a plurality of lugs on bottom sub assembly. This action causes the packer tool to set by compressing rubber elements and holding the elements compressed by a first upper set of slips and a second lower set of slips wedged between the casing and the upper cone and the lower cone. During the setting action, the pickup sleeve and parts attached will move down until the top slips are wedged against the top cone. The spring, which would be fully open when the tool is lowered downhole, will be compressed until the pickup sleeve adaptor shoulders against spring cap. A lock ring holds the spring compressed. Bottom sub assembly includes a threaded nut having lugs protruding into the straight slots and sleeve. The lugs transfer the upward setting force from the mandrel to the sleeve and prevent upward movement of the inner mandrel after the packer is set.

17 Claims, 6 Drawing Sheets

WIRELINE-SET TUBING-RELEASE PACKER APPARATUS

BACKGROUND OF THE INVENTION

1. Field Of The Invention

The present invention relates to wireline packers. More particularly, the present invention relates to a well tool, such as a packer, which may be run on a wireline and set downhole, and released using the tubing string in order to be retrieved from the well bore.

2. General Background

During the process of producing a well, there are various types of packers or packer assemblies which are utilized down the well bore. Usually, the packer is lowered into the well bore, and set within the bore in order to undertake various operations downhole, such as production of the well through the packer from a formation below the packer, or to carry out various operations below the packer, so that the operations conducted below the packer is isolated from the wellbore above the packer.

In the current state of the art, most packers which are positioned downhole require that multiple trips into and out of the well bore must be done in order to complete operations. Since the packer must first be lowered into the hole, set in place, the operations conducted, the equipment which works with the packer must be lowered into the hole, and retrieved from the hole, in separate trips. The packer, itself, must then be retrieved from the hole through a separate run downhole. Due to this multiplicity of trips required, the amount of time to conduct this procedure is very costly to the rig, and usually requires at least four workers in order to complete the operations.

One particular patent which has been granted in the art is cited in the accompanying prior art statement. U.S. Pat. No. 5,197,547, entitled "Wireline Set Packer Tool Arrangement" discloses a packer set by a well string setting tool which can converted to be run and set by a wireline setting tool which includes a body portion a collapsed spring on a mandrel. The packer is supported on a packer support on the mandrel. As the packer is assembled, opposed lugs on the mandrel are placed in a J slot of a housing so that the packer is capable of being set by a wireline pressure setting assembly when the packer tool is positioned in the opening in a casing or in the open hole without requiring further manipulation of the packer tool. The J slot on the housing cooperates with the lugs on the mandrel in setting the packer tool, in releasing the packer tool and in enabling the packer tool to be converted for setting by a well string, or other operations.

The wireline-set tubing-release packer (also referred herein as the FM/WL tool) of the present invention, unlike the tool disclosed and claimed in the '547 patent to Morgan, does not require that it be converted for other uses. Further, the FM/WL tool of the present invention, unlike the tool in the '547 patent, utilizes multiple rotations to release the packer so that accidental release can be avoided, which may occur with the use of the J slot. Further, unlike the tool disclosed in the '547 patent, the invention does not require that the spring be compressed against the top slips when the tool is lowered downhole, but instead is in the fully expanded position prior to being utilized down hole. These and other features which will become apparent differentiate the present invention from the apparatus taught in the '547 patent.

Therefore, it is the principal object of the present invention to provide for a packer which provides for zone isolation, injection, pumping and production, which may be run on a wireline and set downhole, and released utilizing the tubing string and retrieved from the well;

It is a further object of the present invention to provide a simple and economical design of a packer for the above applications which does not require the ability to convert the tool for other uses;

It is a further object of the present invention to provide a packer having an easy-to-assemble design by incorporating a freely expanded spring member in a position so that there is no compression force against the spring member when the tool is being assembled;

It is a further object of the present invention to provide a means by which spring compression is achieved against the top slips, and to further increase the spring force to a predetermined amount during the setting action of the tool so that the top slips remain engaged during pressure reversals;

It is a further object of the present invention to provide a means which requires multiple rotations in order to release the packer to help prevent accidental release which could result if a J slot configuration was utilized.

What follows is a list of the features of the FM/WL Tool which provide for achieving the above-cited objects of the invention.

- Following setting of the FM/WL Tool on the wireline, the packer requires no tension or compression to hold the packer set.
- The FM/WL Tool and tubing can be retrieved in a single trip, since there is no seal assembly involved.
- The bore of the FM/WL Tool is the full tubing inner diameter.
- The rotational release, utilizing drop-away lugs, requires multiple rounds at the tool to release, which prevents accidental release when making tubing connection with a standard On Off tool.
- The threaded rotational release of the FM/WL Tool as expressed is protected from sand or other debris downhole.
- The positive lock-in following spring of the FM/WL Tool protects against premature release during pressure reversals.
- The FM/WL Tool by-pass opens before the upper slips release.
- The FM/WL Tool by-pass is below the upper slips so debris is washed from slips before release.
- A safety release is incorporated into the FM/WL Tool.
- The FM/WL Tool is pressure-rated from 6,000 to 10,000 psi.
- The FM/WL Tool can be run with tailpipe or TCP guns.
- The FM/WL Tool can be run in well under pressure and used as a temporary bridge plug, with several plugging options available.
- The FM/WL Tool accepts a wide variety of accessory items.
- The FM/WL Tool is ideal for wells requiring fiberglass tubing.
- When released the FM/WL Tool is stroked out to prevent swabbing effect.

SUMMARY OF THE PRESENT INVENTION

The FM/WL Tool of the present invention solves the problems in the art in a straightforward manner. What is provided is a tool utilized with a wireline adaptor kit which would be secured to the lower end of a wireline setting tool. The adaptor kit would release from the tool when sufficient setting force is applied, and is retrieved with the wireline setting tool. The wireline setting tool provides for a telescoping action and sufficient force in order to push the outer parts down from the top as the inner mandrel of the tool and the stinger, top sub and bottom sub are pulled upward. The upward pull is transferred to a sleeve by a plurality of lugs on bottom sub assembly. This action causes the packer tool to set by compressing rubber elements and holding the elements compressed by a first upper set of slips and a second lower set of slips wedged between the casing and the upper cone and the lower cone. During the setting action, the pickup sleeve and parts attached will move down until the top slips are wedged against the top cone. The spring, which would be fully open when the tool is lowered downhole, will be compressed until the pickup sleeve adaptor shoulders against spring cap. A lock ring holds the spring compressed. Bottom sub assembly includes a threaded nut having lugs protruding into the straight slots and sleeve. The lugs transfer the upward setting force from the mandrel to the sleeve and prevent upward movement of the inner mandrel after the packer is set. The threaded nut is attached to the bottom sub assembly with a left hand thread. Multiple right hand rotations of the inner mandrel and bottom sub assembly will release the threaded nut and allow the inner mandrel to move upward. This right hand rotation and upward movement of the inner mandrel is the action required for releasing the packer in order to allow it to be retrieved from the hole.

Upper movement of the inner mandrel brings a small outside surface under the seal creating a passage that allows the pressure to equalize. This upward movement also raises the lock ring releasing the spring compression against the top slips and causes a shoulder on the top sub to contact a shoulder on the pickup sleeve. Pulling against the shoulder will pull the top slips loose, releasing the packer. Continued upward movement, of course, would completely retrieve the FM/WL packer from the hole.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
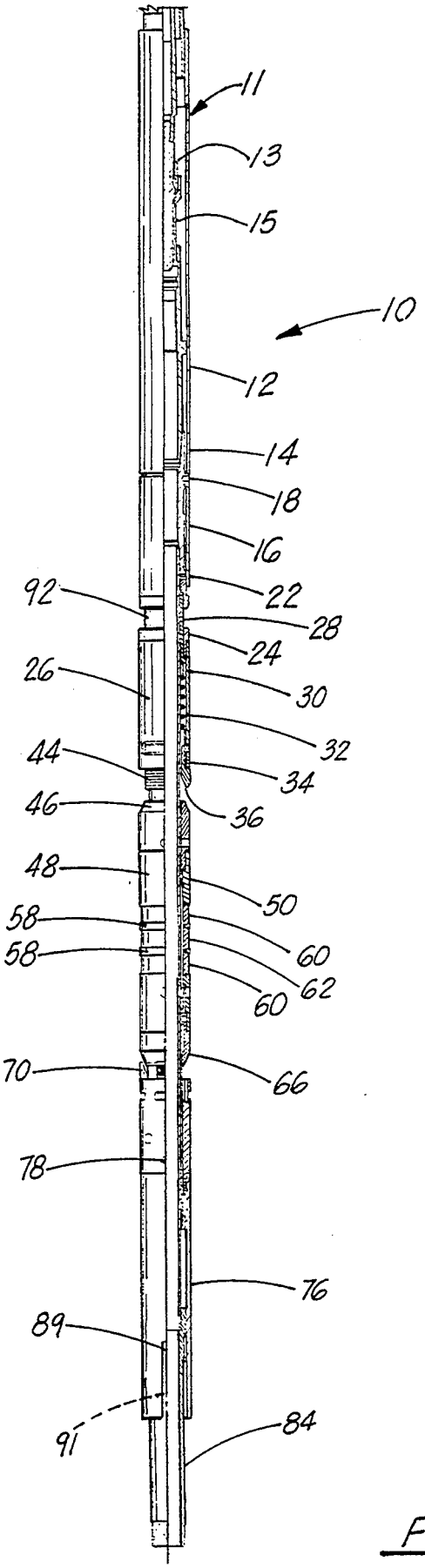
FIG. 1 illustrates in partial cross-section view, the FM/WL tool attached to the wireline adaptor kit for running into the wellbore.

The packer apparatus of the present invention, also referred to as the FM/WL Tool, is illustrated in FIG. 1 by the numeral 10. Prior to a discussion of the operation of the FM/WL Tool 10, reference is made to FIG. 1 for a recitation of the primary components of the tool 10. As illustrated, FM/WL Tool 10 is prepared to be lowered downhole, and initially, comprises an upper stinger 12 secured to a top sub 14. There is further included a pick-up sleeve member 16, held in place to the top sub 14 via a brass shear screw 18. Further, positioned below sleeve member 16 is a pick-up sleeve adapter 22. Below adapter 22 is positioned a spring cage cap 24 which engages an outer spring cage 26 surrounding the inner mandrel 28. There is further provided a lock ring 30 positioned between spring cage 26 and slip joint mandrel 92, which holds spring member 32 in the fully released position as illustrated. There is further provided an upper slip spring 34 engaging the upper slips 36 in a retracted position as illustrated, so that when lowered downhole, the teeth 38 of the slips 36 do not engage the wall 40 of the casing 42.

There is further provided a releasing slip 44 and the upper cone means 46 which engage the slips 36 when the tool positioned in place. Further, there is provided a central coupling 48 and a sealing element 50, which comprises an "0" ring seal. Positioned between sealing element 50 is a second seal 52, and a second "0" ring seal 54 there below. Within central coupling 48 there are provided a plurality of expandable sealing elements 56, which are spaced apart by element spacers 58, thus providing, in the preferred embodiment, three sealing elements, two of which, elements 60, are referred to as Element 90 duro. and one of which, element 62, positioned between elements 60, is referred to as Element 80 duro. There is then provided an annular rubber retainer 64, below lower element 60, contacting the lower cone 66. Cone 66 surrounds an inner rubber mandrel 68, whereby lower slips 70 reside, held in position by lower slip spring 72. There is then provided a control body 74, with a sleeve 76 positioned directly below body 74. Control body 74 includes two buttonhead shear screws 78, with sleeve held in place with a set screw 80. The lower end of the tool provides a rubber cap 82, and a bottom sub assembly 84, having a brass shear screw 86, and an "0" ring sealing means 88.

Figure 2A:
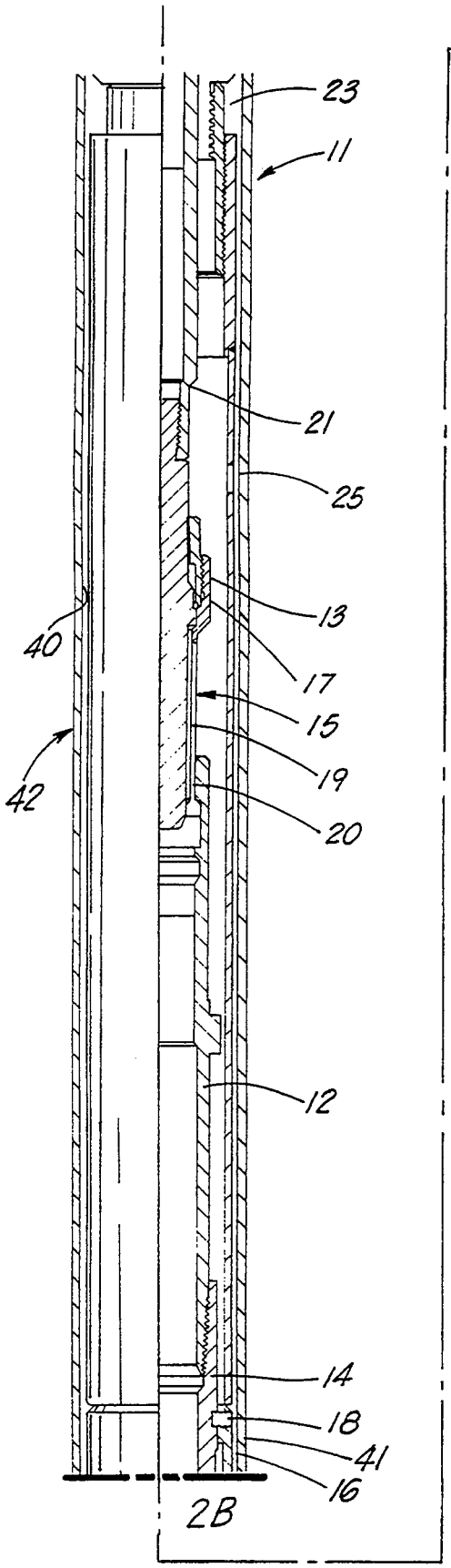
FIG. 2A illustrates a partial view of the upper portion of the FM/WL tool secured to a stinger for lowering down the wellbore.

As illustrated in FIG. 1, the FM/WL packer is illustrated with its wireline adaptor kit 11 made up and ready to run into the casing 42. FIG. 2A illustrates the type M-2 on/off tool stinger 12 made up into the FM/WL packer's top sub 14. The wireline adaptor kit 11 is also illustrated made up and ready to run. The adaptor kit collet fingers 19 are held in place by the tension mandrel 20, which is held in the down position by threading the anvil 13 into the collet 15 and against the shear ring 17. The upper end of the tension mandrel 20 of the wireline adaptor kit 11 is threaded into the nose end of the pressure setting tool 21. The setting sleeve adaptor 23 is screwed onto the O.D. threads of the pressure setting tool 21 and the setting sleeve 25 is threaded over the sleeve adaptor 23 until it contacts the pickup sleeve 16. Pickup sleeve 16 is held in position by two shear screws 18, that thread through the pickup sleeve 16 and bottom out on the top sub 14 of the FM/WL packer 10.

Figure 2B:
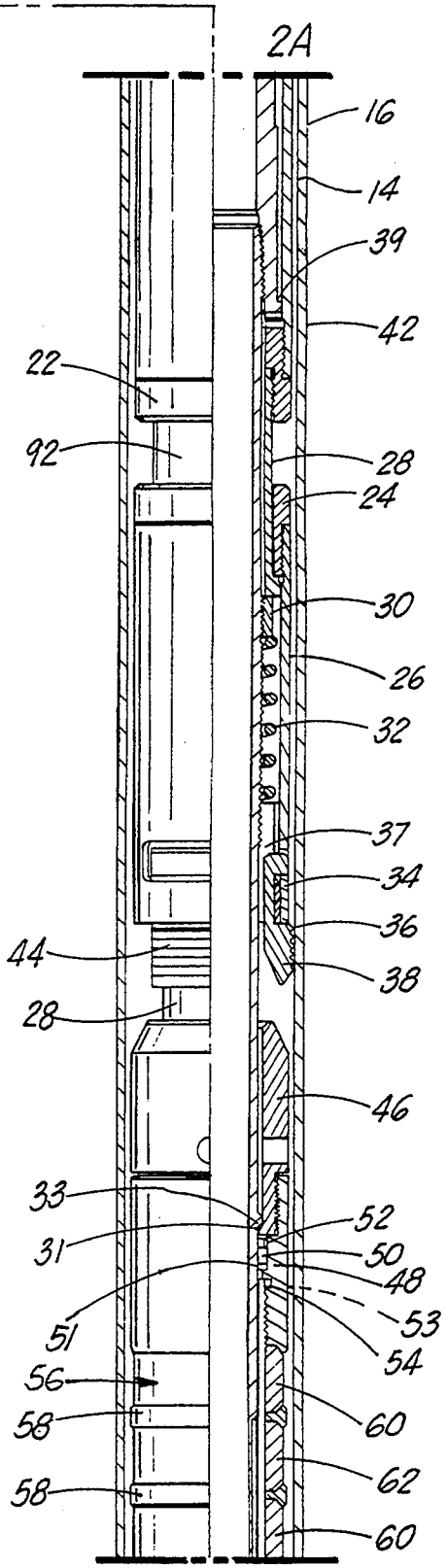
FIG. 2B illustrates a partial view of the pick-up sleeve portion of the FM/WL tool positioned onto the top sub and the pick-up sleeve adapter secured to the pick-up sleeve.

As illustrated in FIG. 2B, the pick-up sleeve 16 is pinned to the top sub 14 and the pick-up sleeve adaptor 22 is threaded into the pick-up sleeve 16. The slip joint mandrel 92 is screwed into the pick-up sleeve adaptor 22 and extends into the spring cage 26 and is held in place by the spring cage cap 24. Below the slip joint mandrel 92 and inside the spring cage 26 is the lock ring 30 with upper facing threads. Lock ring 30 rests on the inner mandrel 28 at the start of the downward facing threads. The lock ring 30 will slide downward over the inner mandrel threads but must be unthreaded to return to the up position. Below the lock ring 30 is coil spring 32 held in place in its fully extended length by the lock ring 30 and the slip blocks 37 on upper slips 36 on the spring cage 26 . The upper slips 36 are held away from the upper cone 46 by all of the above mechanisms being connected to the pick-up sleeve 16 which is pinned to the top sub 14. The upper cone 46 is threaded into the central coupling 48. These two parts are pushed upward on the inner mandrel 28 until the lip 31 on the lower inside of the upper cone 46 contacts the upset 33 just above the inner mandrel seal area 50. The seal 52 in the central coupling 48 will remain until released. The rubber mandrel 68 with three packing elements, upper element 60 (90 duro.), central element 62 (80 duro.) and lower element 60 (90 duro.) are separated by two element spacers 58 and rubber retainer 64, which are threaded into the central coupling 48.

Figure 2C:
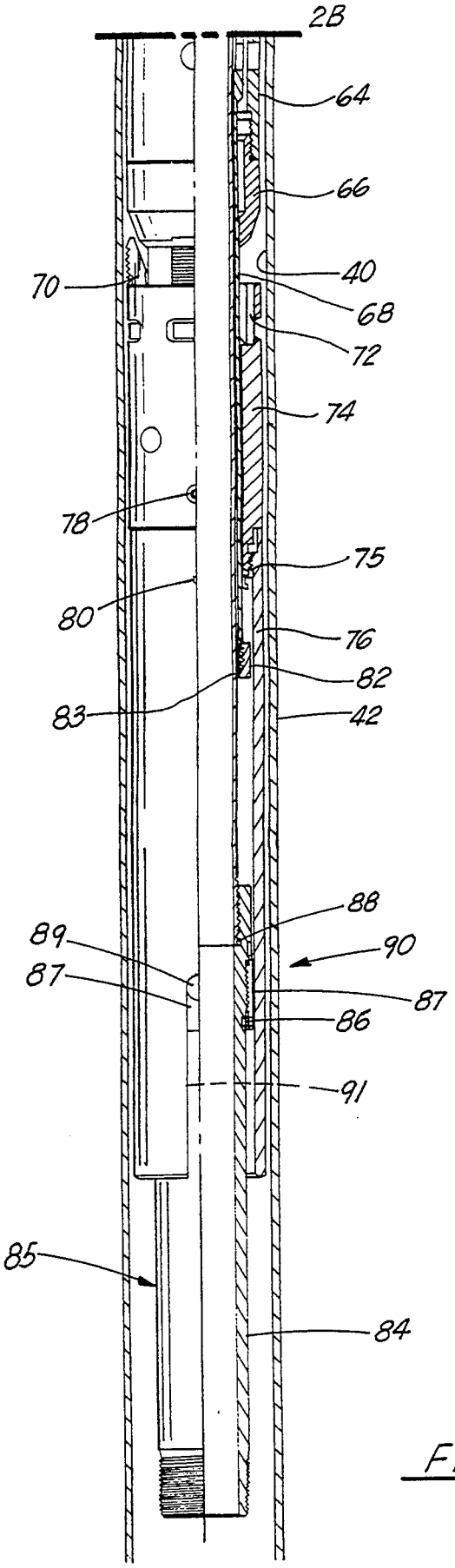
FIG. 2C illustrates a partial view of the lower cone portion of the FM/WL tool secured into a retainer.
Figure 3A:
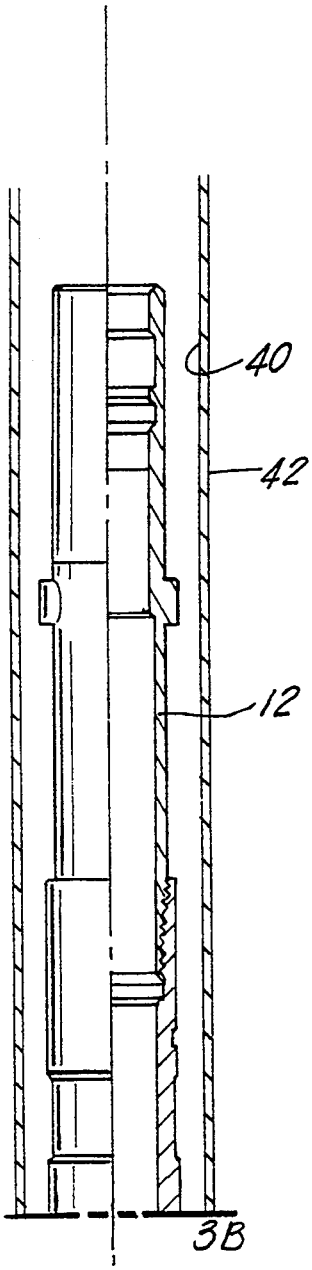
FIG. 3A illustrates the stinger and the FM/WL tool following the packer having been set and the wireline adapter kit released from the tool.

In FIG. 2C there is illustrated the lower cone 66 threaded into the rubber retainer 64. The control body 74 holds the lower slips 70 in position. The control body 74 is held in place by two button-head shear screws 78, that thread through the control body 74 into slots in the rubber mandrel 68. The rubber mandrel cap 83 is screwed into the lower end 83 of the rubber mandrel 68. The sleeve 76 threads onto the control body 74 with left hand threads 75. The bottom sub 84 threads onto the lower end 85 of the inner mandrel 28. And, in FIG. 3A, there is illustrated the M-2 On/Off tool stinger 12 and the FM/WL top sub 14 after the packer 10 has been set and the wireline adapter kit 11 has been released.

Figure 3B:
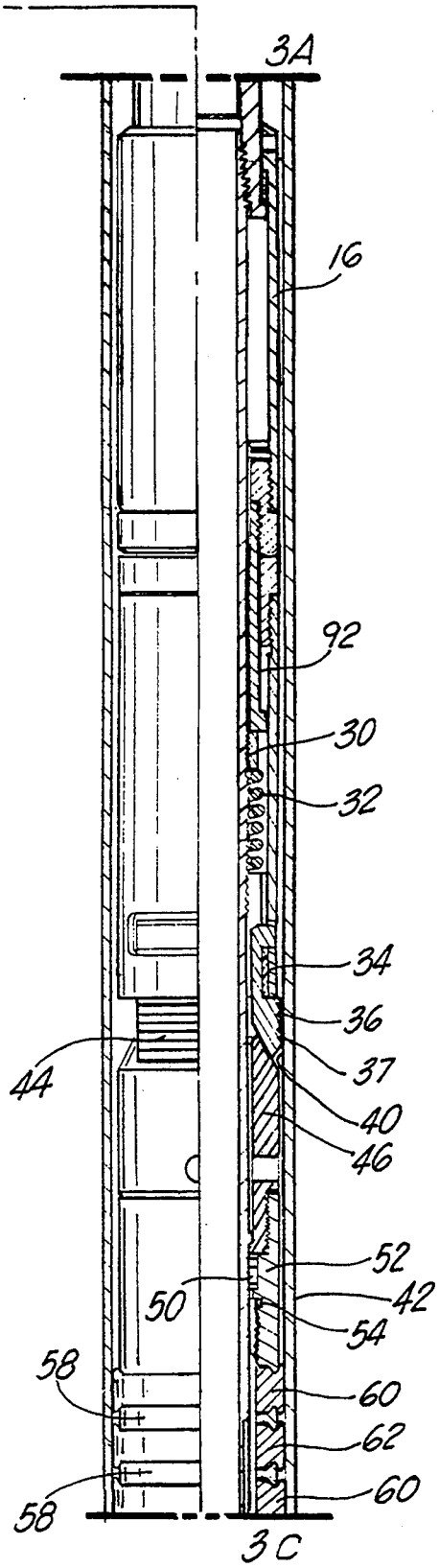
FIG. 3B illustrates the operation of the FM/WL tool as it is positioned to pack off the elements after it is secured against the walls of the borehole.
Figure 3C:
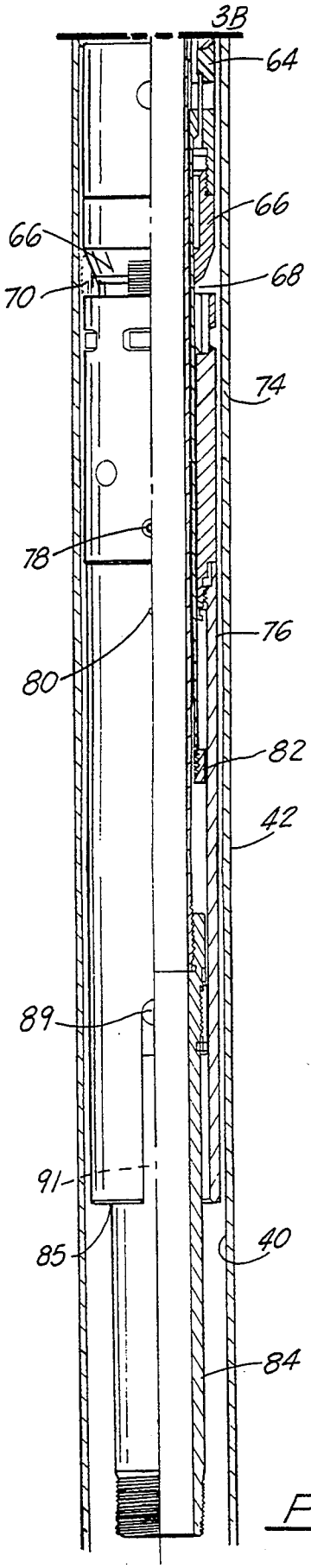
FIG. 3C illustrates portions of the FM/WL tool when the tool is operating downhole.

As illustrated in FIG. 3B, the pick-up sleeve 16 has been sheared down, pushing the slip joint mandrel 92 down. The slip joint mandrel 92 forces down on the locking ring 30 which forces down on the spring cage 26 causing the slips to contact the upper cone 46 and the casing wall 40. More force causes the slips 46 to bite into the casing 42 and loads the spring 32 to force the spring cage 26 down. Force causes the inner mandrel 28 to move up packing off the elements 60 and 62. As seen in FIG. 3C, upward movement at the inner mandrel 28 shears the buttonhead shear screws 78 in the control body 74 and the sleeve 76 causing greater pack-off force and at a preset point shears the shear ring 17 in the wireline adapter kit 11.

Figure 4A:
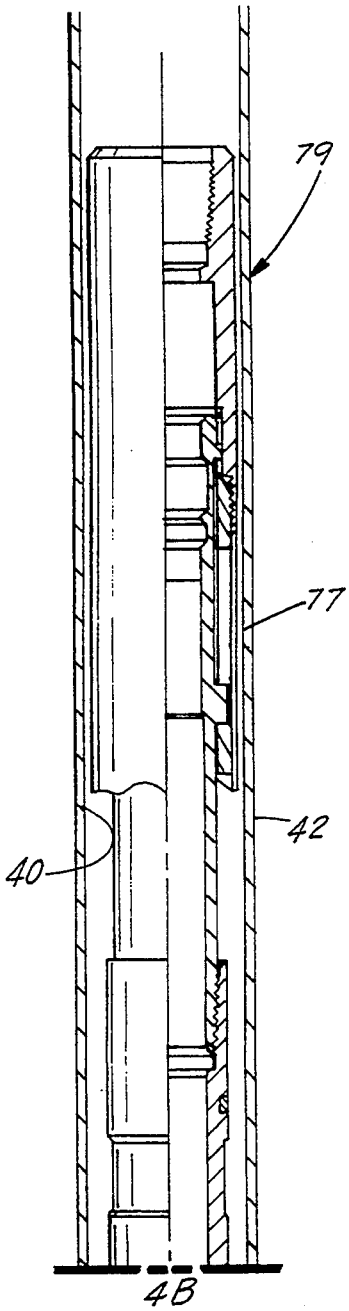
FIG. 4A illustrates overshot of an M-2 On/Off tool engaged on a stringer.
Figure 4B:
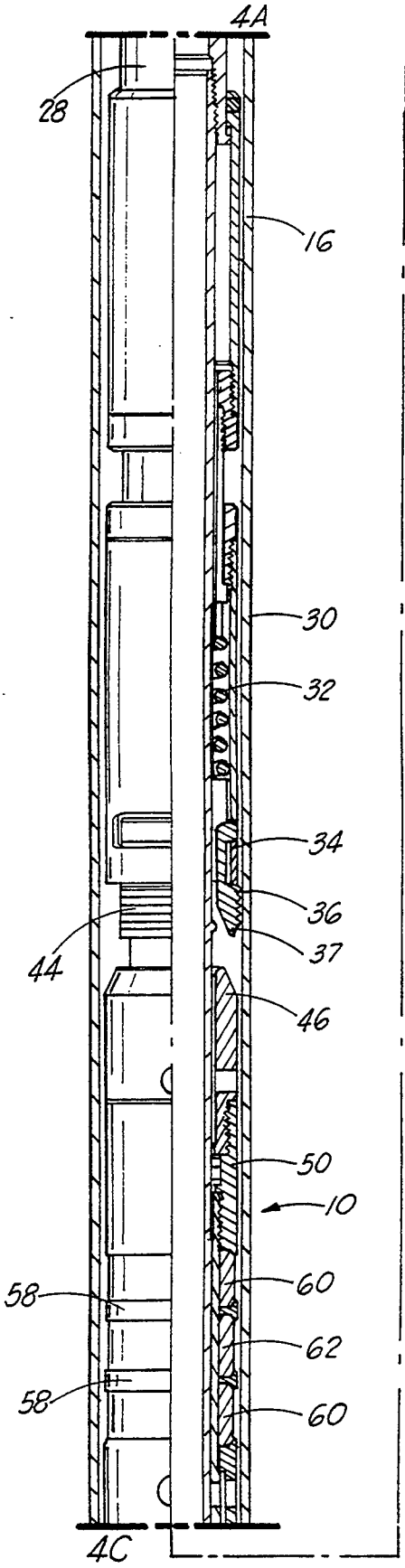
FIG. 4B illustrates the FM/WL tool following the rotation of the tubing in order to allow the mandrel to be moved up, releasing the upper cone and lower parts of the packer.
Figure 4C:
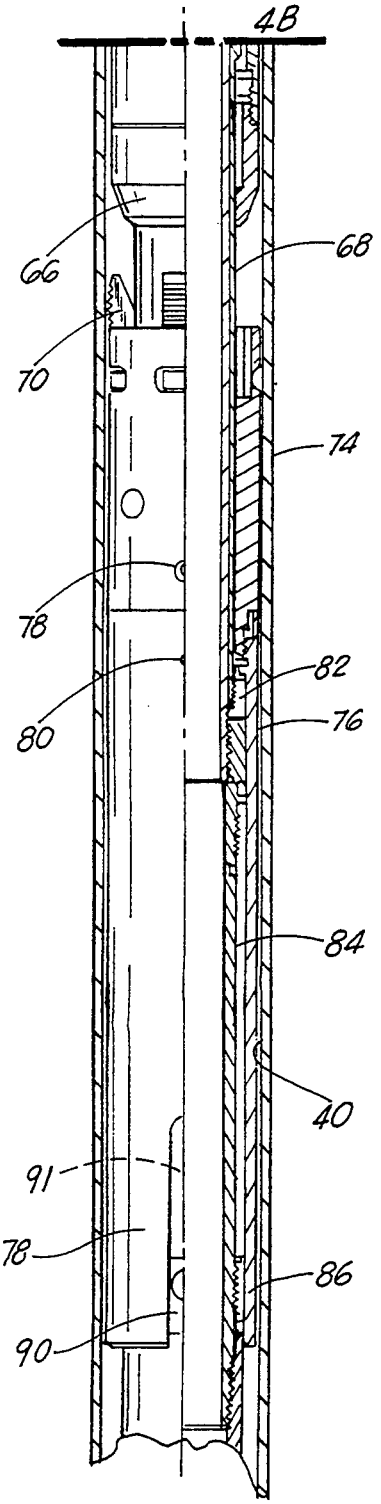
FIG. 4C illustrates the FM/WL tool ready for retrieval after the slips have been released from the cones, and allows the tool to be pulled from the well.

Further, in FIG. 4A, the overshot 77 of M-2 On/Off Tool 79 engages the stinger 12. At this point, a pump out plug can be pumped out or a profile plug removed from below the packer 10. Production can be flowed up the tubing or the well can be stimulated. The overshot 77 uses two bonded seals to effect a tubing seal and to protect the annulus of the casing 42 from fluid or gas flow. The FM/WL packer 10 can also be released and retrieved at this time. This is accomplished by rotating the tubing to the right multiple times, in the preferred embodiment nine rotations, and the mandrel 28 can then be moved upward. Two shear pins 86 are sheared and the lug assembly 90 drops away from the sleeve 78. As seen in FIG. 4B, following the rotation of the tubing its nine turns to the right, the mandrel 28 can be moved up by pulling on the tubing, thus releasing the upper cone 46 and lower parts of the packer 10. While FIG. 4C shows lug assembly 90 dropped away from sleeve 76 allowing mandrel 28 to move upward and release upper slips 36 from upper cone 46 and release lower slips 70 from lower cone 66. This process allows rubber elements 60 and 62 to relax, and thus allows the tool 10 to be removed from the casing 42.

Operation of the FM/WL Tool

In the illustration in FIG. 1, the FM/WL tool 10 illustrates the wireline adaptor kit 11 which would be secured to the lower end of a wireline setting tool (not illustrated). As illustrated, the adaptor kit 11 releases from the FM/WL tool 10 when sufficient setting force is applied, and is retrieved out of the casing 42 with the wireline setting tool. The wireline setting tool provides for a telescoping action and sufficient force in order to push the outer parts down from the top as the inner mandrel 28, the stinger 12, the top sub 14, and the bottom sub assembly 84 are pulled upward. The upward pull is transferred to sleeve 76 by the lugs 89 on bottom sub assembly 84. This action causes the FM/WL packer tool 10 to set by compressing the rubber elements 60 and 62 and holding the elements 60 and 62 compressed by a first upper set of slips 36 and a second lower set of slips 70 wedged between the casing 42 and the upper cone 46 and the lower cone 66. During the setting action, the pickup sleeve 16 and parts attached will move down until the upper slips 36 are wedged against the top cone 46. A compressible member such as a spring 32, which is normally fully expanded when the tool is lowered into the casing 42, will be compressed until the pickup sleeve adaptor 22 shoulders against spring cap 24. The lock ring 30 holds the spring member 32 compressed. It is during this locked position of the tool 10 within the annulus of the casing 42 in which the various tasks within the borehole may be undertaken so that the borehole may be isolated between that portion of the borehole above packer 10 from that portion below packer 10.

Following the work to be undertaken in the borehole, the packer 10 would be ready to be retrieved from the casing. In order to accomplish this, bottom sub assembly 84 includes a threaded nut 87 that has lugs 89 protruding into the two straight slots 91 in sleeve 76. The lugs 89 transfer the upward setting force from the mandrel 28 to the sleeve 76 and prevent upward movement of the inner mandrel 28 after the FM/WL packer 10 is set. The threaded nut 87 is attached to the bottom sub assembly 84 with the left hand thread. In order to release the packer, unlike the prior art, where a J slot is utilized, multiple right hand rotations of the inner mandrel 28, in the preferred embodiment a total of 9 rotations, and bottom sub assembly 84 will release the threaded nut 87 and allow the inner mandrel 28 to move upward. This right hand rotation and upward movement of the inner mandrel 28 is the action required for releasing the FM/WL packer 10 in order to allow it to be retrieved from the hole.

Upper movement of the inner mandrel 28 brings a small outside surface 51 under the second seal 52 creating a passage 53 that allows the pressure to equalize. This upward movement also raises the lock ring 30 releasing the spring compression against the top slips 36 and causes a shoulder 39 on the top sub 14 to contact a shoulder 41 on the pickup sleeve 16. Pulling against the shoulder 41 will pull the top slips 36 loose, releasing the FM/WL packer 10. Continued upward movement, of course, would completely retrieve the FM/WL packer 10 from the hole.

PARTS LIST

| Part Number | Description |
|---|---|
| 10 | FM/WL Tool |
| 11 | wireline adaptor kit |
| 12 | upper stinger |
| 13 | anvil |
| 14 | top sub |
| 15 | collet |
| 16 | pick-up sleeve member |
| 17 | sheer ring |
| 18 | shear screw |
| 19 | collet fingers |
| 20 | tension mandrel |
| 21 | pressure setting tool |
| 22 | adaptor |
| 23 | sleeve adaptor |
| 24 | spring cage cap |
| 25 | setting sleeve |
| 26 | spring cage |
| 28 | inner mandrel |
| 30 | lock ring |
| 31 | lip |
| 32 | spring member |
| 33 | upset |
| 34 | upper slip spring |
| 36 | upper slips |
| 37 | slip blocks |
| 38 | teeth |
| 39 | shoulder |
| 40 | borehole wall |
| 41 | shoulder |
| 42 | borehole |
| 44 | releasing slip |
| 46 | upper cone means |
| 48 | central coupling |
| 50 | sealing element |
| 51 | outside surface |
| 52 | second seal |
| 53 | passage |
| 54 | "O" ring seal |
| 56 | sealing elements |
| 58 | element spacers |
| 60 | element duro 90 |
| 62 | element duro 80 |
| 64 | rubber retainer |
| 66 | lower cone |
| 68 | inner rubber mandrel |
| 70 | lower slips |
| 72 | lower slip spring |
| 74 | control body |
| 75 | left hand threads |
| 76 | sleeve |
| 77 | overshot |
| 78 | shear screw |
| 79 | On/Off Tool |

-continued

PARTS LIST

| Part Number | Description |
|---|---|
| 80 | set screw |
| 82 | rubber cap |
| 83 | lower end |
| 84 | bottom sub assembly |
| 85 | lower end of mandrel |
| 86 | shear screw |
| 87 | threaded nut |
| 88 | "O" ring means |
| 89 | lugs |
| 90 | lug assembly |
| 91 | slots |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A well tool for use with a wireline, comprising:

a) a primary tool body for positioning on the end of the wireline to be lowered into a cased well;

b) a bottom sub assembly positioned on the lower end of the primary tool body;

c) a compressible spring member supported on the tool body which is expanded when the tool body is lowered into the cased well;

d) means on the bottom sub assembly for engaging the lower portion of the tool body;

e) means on the tool body for compressing the spring member so that the upper portion of the tool body is forced downward, and the lower portion of the tool body is forced upward;

f) upper slip means positioned on the upper portion of the tool body for engaging the wall of the casing when that portion of the tool body is forced downward;

g) lower slip means positioned on the lower portion of the tool body for engaging the wall of the casing when that portion of the tool body is forced upward;

h) flexible sealing means, positioned on the outer wall of the tool body for expanding outward when the portions of the tool body are forced downward and upward to form a seal between the tool body and the wall of the casing; and i) a threadable member connecting the tool body to the bottom sub assembly so that the bottom sub assembly is disengaged from the tool body following multiple rotations of the tool body, releasing the sealing means from the wall of the casing so that the tool body can be retrieved from the well.

2. The tool in claim 1, further comprising a wireline adaptor kit secured between the tool body and a wireline setting tool.

3. The tool in claim 1, further comprising a stinger secured between the tool body and the wireline adaptor kit.

4. The tool in claim 1, wherein the tool body further comprises an inner mandrel portion as part of the tool body.

5. The tool in claim 1, wherein the bottom sub assembly further comprises a pair of lugs which engage the tool body in order to move that portion of the body upward.

6. The tool in claim 1, wherein the upper slip means and the lower slip means further comprise jaw portions for engaging a cone portion of the body in order to set in position against the wall of the casing.

7. The tool in claim 1, wherein the flexible sealing means further comprises at least one rubberized annular seal, which, when the portions of the tool body are moved upward and downward, compress outward to sealingly engage the wall of the casing.

8. The tool in claim 1, wherein the threadable member comprises a threaded nut which is rotated at least two rotations in order to disengage from the bottom sub assembly in order to release the tool from sealing engagement with the casing wall.

9. A FM/WL packer for use with a wireline, comprising:

a) a primary body for positioning on the end of the wireline to be lowered into a cased well;

b) a bottom sub assembly positioned on the lower end of the primary body;

c) a compressible spring member supported on the primary body which is expanded when the primary body is lowered into the cased well;

d) means on the bottom sub assembly for engaging the lower portion of the primary body;

e) means on the tool body for compressing the spring member so that the upper portion of the primary body is forced downward, and the lower portion of the primary body is forced upward;

f) upper slip means positioned on an upper portion of the primary body for engaging the wall of the casing when that portion of the primary body is forced downward;

g) lower slip means positioned on a lower portion of the primary body for engaging the wall of the casing when that portion of the primary body is forced upward;

h) flexible sealing means, positioned on the outer wall of the tool body for expanding outward when the upper and lower portions of the primary body are forced upward and downward to form a seal between the tool body and the wall of the casing; and i) a threadable member connecting the primary body to the bottom sub assembly so that the bottom sub assembly is disengaged from the primary body following multiple rotations of the primary body, releasing the sealing means from the wall of the casing so that the primary body can be retrieved from the well.

10. The tool in claim 9, further comprising a wireline adaptor kit secured between primary tool body and a wireline setting tool as the packer is moved down the borehole.

11. The tool in claim 9, further comprising a stinger secured between the primary body and the wireline adaptor kit.

12. The tool in claim 9, wherein the primary body further comprises an inner mandrel portion as part of the tool body secured to the bottom sub assembly.

13. The tool in claim 9, wherein the bottom sub assembly further comprises two or more lugs which engage slots in the primary body in order to move that portion of the body upward.

14. The tool in claim 9, wherein the upper slip means and the lower slip means further comprise jaw portions for engaging upper and lower cone portions of the body in order to move outward and set in position against the wall of the casing.

15. The tool in claim 9, wherein the flexible sealing means further comprises at least one rubberized annular seal, which, when the portions of the primary body are moved upward and downward, compress outward to sealingly engage the wall of the casing.

16. The tool in claim 9, wherein the threadable member comprises a threaded nut which is rotated at least two rotations in order to disengage from the bottom sub assembly, returning the upper and lower portions of the primary body to their former positions, and releasing the tool from sealing engagement with the casing wall for retrieval.

17. A method of setting and releasing a wireline set packer down a cased borehole, comprising the following steps:

a) lowering a packer body at the end of a wireline down the cased hole, the body having a fully expanded spring member supported thereupon;

b) providing sealing means supported on the body member for engaging the casing wall;

c) securing a bottom sub assembly to the lower end of the packer body;

d) moving an upper portion of the packer body downward to compress the spring member;

e) moving a lower portion of the packer body upward simultaneously as the spring member is compressed;

f) forcing the sealing means outward from the packer body when the spring is compressed, so that the sealing means sealingly engages the wall of the casing to set the packer;

g) rotating the packer body in relation to the bottom sub assembly sufficient rotations so that the body disengages the bottom sub assembly, and the upper and lower portions of the packer return to their former positions, to disengage the sealing means from the wall of the casing; and h) retrieving the packer from the cased hole.

* * * * *